United States Patent [19]

Daniel

[11] Patent Number: 4,635,656

[45] Date of Patent: Jan. 13, 1987

[54] FINGERNAIL CLEANER COMPRISING FAUCET ATTACHMENT WHICH PROVIDES SHIELDED JET STREAM

[76] Inventor: Charles G. Daniel, 83 Sunrise Ave., Mill Valley, Calif. 94941

[21] Appl. No.: 818,895

[22] Filed: Jan. 14, 1986

Related U.S. Application Data

[63] Continuation of Ser. No. 489,027, Apr. 27, 1983, abandoned.

[51] Int. Cl.[4] ..... A45D 29/20

[52] U.S. Cl. ..... 132/75; 132/74.5

[58] Field of Search ..... 132/75, 74.5

[56] References Cited

U.S. PATENT DOCUMENTS

| | | | |
|---|---|---|---|
| 2,722,224 | 11/1955 | Blann | 132/88.5 |
| 3,935,973 | 2/1976 | Weyn | 222/402.12 |
| 4,209,027 | 6/1980 | Morganroth | 132/9 |

FOREIGN PATENT DOCUMENTS

| | | | |
|---|---|---|---|
| 679202 | 1/1977 | U.S.S.R. | 401/268 |

*Primary Examiner*—Gregory E. McNeill

*Attorney, Agent, or Firm*—David Pressman

[57] ABSTRACT

A fingernail cleaner comprising a cylindrical tubular housing with an orifice disc across it intermediate the top and bottom. A nozzle in the orifice disc projects a jet of water at high velocity. The space above the orifice disc comprises a soap chamber and the depending cylindrical portion below the orifice disc forms a skirt to function as a splash guard.

4 Claims, 2 Drawing Figures

FINGERNAIL CLEANER COMPRISING FAUCET ATTACHMENT WHICH PROVIDES SHIELDED JET STREAM

This application is a continuation of Ser. No. 489,027, filed Apr. 27, 1983, now abandoned.

BACKGROUND OF THE INVENTION

Many people indulge in activities, for a livelihood, as well as for recreation and relaxation, which can hardly be performed without getting one's hands dirty. For example, in gardening, it is often necessary for one to manipulate the soil in one way or another, causing the soil to be caked under one's fingernails. In most cases, the dirt and/or soil can be removed from the hand simply by washing with soap and water, but it is considerably more difficult to remove the soil from under the nails. In addition to the removal of dirt, there are many professions, such as medicine where it is necessary to keep the hands and nails free of bacteria, whether or not the presence of dirt is apparent.

OBJECTS OF THE INVENTION

It is an object of this invention to provide an easily operated device for cleaning under the fingernails.

It is a further object of this invention to provide means for washing under the fingernails with soap and water.

It is a further object of this invention to provide means for washing the fingernails without excessive scrubbing.

Other objects and advantages of this invention will become apparent from the description to follow, particularly when read in conjunction with the accompanying drawing.

SUMMARY OF THE INVENTION

In carrying out this invention, I provide a tubular housing having an orifice plate across it, intermediate the top and bottom ends. At the top end, a snap-on attachment enables it to be connected to a water spigot quickly, and the bottom end below the orifice plate forms a skirt to function as a splash guard. A nozzle in the orifice plate projects a downward jet of water so that one may simply insert his fingers up into the bottom end (one at a time) to have his nails cleaned with a jet of soapy water, with the depending skirt minimizing splashing against the surrounding surfaces.

DESCRIPTION OF A PREFERRED EMBODIMENT

Figure 1:
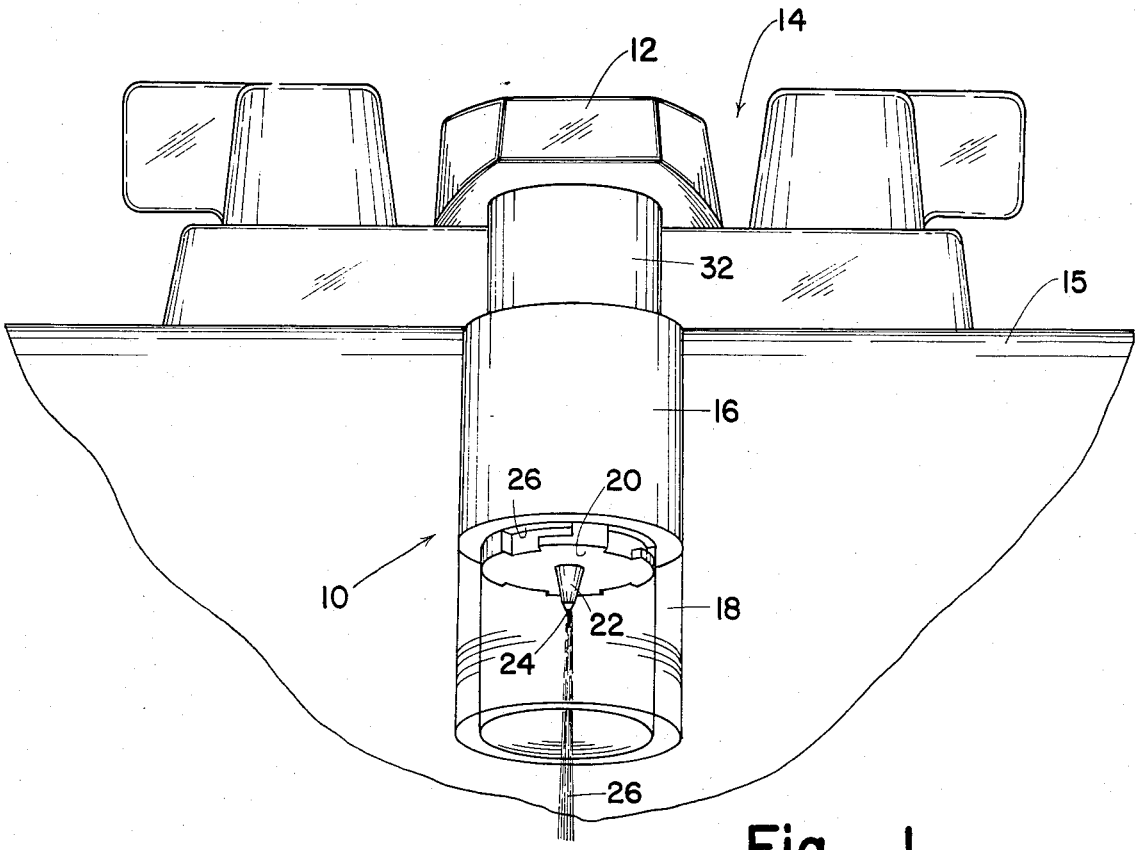
FIG. 1 is a view in perspective of the nail cleaner of this invention as attached to the spigot of a wash basin.
Figure 2:
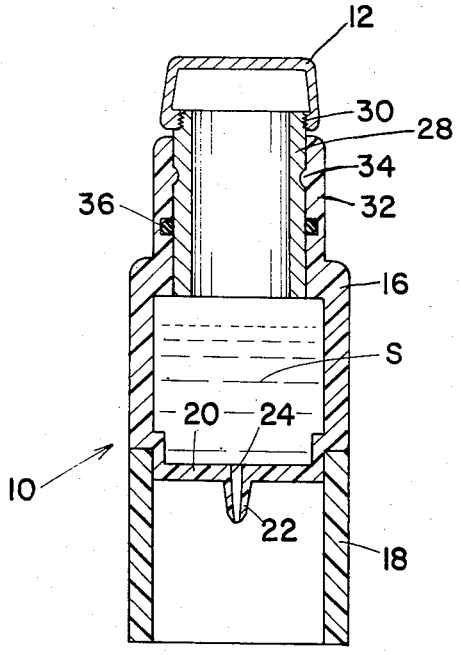
FIG. 2 is a section view taken through the spigot and nail cleaner.

Referring now to the drawing, a fingernail cleaner 10 of this invention is shown attached to a water tap 12 of a conventional fixture 14 for a washroom basin 15. Nail cleaner 10 comprises a generally cylindrical housing having an upper cylindrical soap receptacle 16 and a lower cylindrical anti-splash skirt 18. An orifice plate or wall 20 across the lower end of receptacle 16 has a central, coaxial nozzle 22 formed with an orifice 24 which is adapted to project a narrow, high velocity jet of water 26. Skirt 18 may be secured to the receptacle 16 by any suitable means, such as an L-slot 26 shown in FIG. 1.

The fingernail cleaner of this invention may be adapted for quick connection to a water tap 12, as by providing a downspout 28, which is threaded at 30 into a tap 12. An upwardly extending neck 32 on a soap receptacle 16 may be provided with a number of internal nodules 34 which are received in complementary arcuate grooves around a downspout 28. Suitable sealing means, such as an O-ring 36 may be provided to ensure watertight integrity of the joint.

In operation, a quantity of soap S, such as a liquid soap, may be placed in a receptacle 16 above a orifice plate 20 and a fingernail cleaner 10 is attached to a spigot by slipping it up over a downspout 28. When a water is turned on, a high velocity jet 26 is projected from the nozzle 22, and one need merely insert his or her fingers (one at a time) up into depending skirt 18 to allow the jet to project directly under the nails while the skirt confines any splashing.

While this invention has been described in conjunction with a preferred embodiment thereof, it is obvious that modifications and changes therein may be made by those skilled in the art to which it pertains without departing from the spirit and scope of this invention, as defined by the claims appended hereto.

What is claimed as invention is:

1. A fingernail cleaner, comprising:

a straight cylindrical housing having a flow passageway therethrough, said cylindrical housing having open top and bottom ends, the top end of said housing having attachment means thereat for attaching said cylindrical housing to a water tap such that water flowing out of said tap will flow into the top end of said housing, a plate positioned across the passageway of said cylindrical housing intermediate said top and bottom ends thereof, said plate being mounted perpendicularly to the axis of said cylindrical housing, said plate having top and bottom surfaces facing said open top and bottom ends, respectively, of said cylindrical housing, said plate having an orifice therein, a nozzle attached to and extending from said bottom surface of said plate and pointing to said open bottom end of said cylindrical housing, said nozzle being positioned coaxially with said cylindrical housing and extending along the axis of said cylindrical housing from a central portion of said plate, said nozzle having an orifice therethrough communicating with said orifice in said plate, said orifice of said nozzle being arranged and shaped so that water forced therethrough from said tap will leave the tip of said nozzle in a high velocity jet stream which will be directed along the axis of said housing and directly at said bottom open end of said housing, a bottom portion of said cylindrical housing forming a skirt which is positioned coaxially around said nozzle so as to form a shield completely surrounding the sides of said nozzle, said bottom portion of said cylindrical housing being long enough so that the tip of said nozzle is spaced, in an axial direction, up from said bottom open end of said cylindrical housing so that a user can insert a finger up into said skirt portion and position said tip of said nozzle under the nail of said finger so that the jet of water leaving said tip of said nozzle will clean the area under said nail and so that said skirt will confine any splashing.

2. The fingernail cleaner of claim 1 wherein said cylindrical housing contains a soap chamber above said plate.

3. The fingernail cleaner of claim 1 wherein said nozzle is conically shaped.

4. A fingernail cleaner, comprising:

a straight cylindrical housing having a flow passageway therethrough, said cylindrical housing having open top and bottom ends, the top end of said housing having attachment means thereat for attaching said cylindrical housing to a water tap such that water flowing out of said tap will flow into the top end of said housing, a plate positioned across the passageway of said cylindrical housing intermediate said top and bottom ends thereof, said plate being mounted perpendicularly to the axis of said housing, said plate having top and bottom surfaces facing said open top and bottom ends, respectively, of said cylindrical housing, said plate having an orifice therein, a conical nozzle attached to and extending and pointing downwardly along the axis of said housing from said bottom surfce of said plate, said nozzle being positioned coaxially with said cylindrical housing so that its tip points toward said open bottom end of said cylindrical housing, said nozzle havng an orifice therethrough communicating with said orifice in said plate, said orifice of said nozzle being arranged and shaped so that water forced therethrough from said tap will leave the tip of said nozzle in a high velocity jet stream which will be directed along the axis of said housing and directly at said bottom open end of said housing, a bottom portion of said cylindrical housing forming a skirt which is positioned coaxially around said nozzle so as to form a shield completely surrounding the sides of said nozzle, said bottom portion of said cylindrical housing being long enough so that the tip of said nozzle is spaced, in an axial direction, up from said bottom open end of said cylindrical housing so that a user can insert a finger into said skirt portion and position said tip of said nozzle under the nail of said finger so that the jet of water leaving said tip of said nozzle will clean the area under said nail and so that said skirt will confine any splashing, said housing containing a chamber above said plate and below said attachment means for holding a quantity of soap in said chamber.

* * * * *